US005170821A

United States Patent [19]

Yoshida

[11] Patent Number: 5,170,821

[45] Date of Patent: Dec. 15, 1992

[54] WARP TENSION CONTROL APPARATUS WITH TENSION REDUCTION DURING LOOM STOP

[75] Inventor: Toshio Yoshida, Kanazawa, Japan

[73] Assignee: Tsudakoma Corp., Ishikawa, Japan

[21] Appl. No.: 697,674

[22] Filed: May 9, 1991

[30] Foreign Application Priority Data

May 11, 1990 [JP] Japan ..... 119886

[51] Int. Cl.[5] ..... D03D 49/04

[52] U.S. Cl. ..... 139/99; 139/110

[58] Field of Search ..... 139/99, 110

[56] References Cited

U.S. PATENT DOCUMENTS

| | | | |
|---|---|---|---|
| 3,072,154 | 1/1963 | Locher | 139/110 |
| 4,750,527 | 6/1988 | Rehling | 139/110 |
| 5,024,253 | 6/1991 | Kawalata et al. | 139/99 |

FOREIGN PATENT DOCUMENTS

| | | | |
|---|---|---|---|
| 2021845 | 1/1987 | Japan | 139/99 |
| 288252 | 11/1988 | Japan | 139/99 |
| 1260041 | 10/1989 | Japan | 139/99 |

*Primary Examiner*—Andrew M. Falik

*Attorney, Agent, or Firm*—Wenderoth, Lind & Ponack

[57] ABSTRACT

A warp tension control apparatus includes a tension detector for detecting the tension of a warp and an operation mode controller for generating a control signal to drive a motor so as to minimize the deviation between the detected tension and a normal target tension. A long period stop mode controller is included for controlling the tension so that a target slack tension is set to be less than the normal target tension when a loom stop signal has been issued. A selector switch is provided for selectively switching to a contact connected to an output of the long period stop mode controller before entering a long unmanned operating period of the loom, the switch being disposed in a circuit between an input terminal of the long period stop mode controller which receives a loom stop signal and a warp tension slack device. A switch is provided for stopping the output of the operation mode controller when the long period stop mode controller outputs the slack tension control signal such that the warp tension when the loom is stopped is said to be less than that at the time of normal operation only when the selector switch is selectively switched to a contact connected to the output of the long period stop mode controller.

6 Claims, 5 Drawing Sheets

WARP TENSION CONTROL APPARATUS WITH TENSION REDUCTION DURING LOOM STOP

BACKGROUND OF THE INVENTION

1. Field of the Invention

The present invention relates to an apparatus for controlling a warp tension to an appropriate tension value when a loom stops.

2. Description of the Related Art

Japanese Patent Publication No. 36-4029 discloses a technique in which the warp tension is set to be slackened by an electronic control system when a loom stops.

It is effective that the warp tension is slackened when the loom stops for a long period of time. On the contrary, a weaving bar is liable to be generated when the loom stops for a short period of time; hence; the slackening of the warp tension is not an effective means. That is, it is necessary to return the tension value to a normal value when a cloth fell is returned to a regular position in the case of the restarting of the loom after the slackening of the warp. However, inasmuch as a delicate setting of the tension value depends on the kind of texture in consideration of the stretch of the warp during the stoppage of the loom, it is not easy to adjust the warp tension or the position of the cloth fell. If such an adjustment is erroneously made, it causes a new weaving bar.

Thus, even if the warp tension is not slackened when the loom stops for a short period of time, a weaving bar is rarely generated. Accordingly, at this time, it is preferable for the warp tension to not be slackened but kept as it is without generating the cause of the weaving bar due to the slackening of the warp tension.

Particularly, in the recent working or operating mode, the stop time of the loom is largely differentiated depending on the mode of working. That is, when the loom stops during normal working hours, an operator removes the cause of the stoppage in a relatively short time and sets the loom to be restarted so that the stop time is relatively short. On the other hand, when the loom stops once during unmanned operating hours, such as night time or holidays, the loom stops for a continuous long period of time until the succeeding normal working hours occur. Under such circumstances, it is necessary to control the warp tension so as to be an appropriate value depending on the length of the stop page of time of the loom.

SUMMARY OF THE INVENTION

It is therefore an object of the present invention to realize a warp tension control apparatus capable of setting the warp tension value to an appropriate value depending on the length of time that the loom is stopped and for setting the warp tension to an appropriate slack.

To achieve the above object, the present invention is provided with a long period stop mode controller whose output is selectively supplied by a selector switch to a warp tension slack means. The warp tension slack means may comprise a take-up control system or a tension roller position control system and the like in addition to a let-off control system and the like.

The long period stop mode controller comprises a first control unit for slackening the warp tension when the loom stops for a long period of time and a second control unit for previously setting the warp tension to a normal tension before the loom starts, if need be. These first and second control units can be driven by a signal to be issued at a given time in addition to a loom stop signal and the like.

When the set switch is selected to a normal stop mode during normal working hours, a long period stop mode control does not operate the warp tension slack means when the loom stops.

Meanwhile, the operator switches the selector switch to the long stop mode before the start of the unmanned operating hours, such as night time or holidays. Accordingly, when the loom stops during the unmanned operating hours, the first control unit in the long period stop mode controller drives the warp tension slack means so that, the warp tension is adjusted to approach a predetermined slack tension. The second control unit in the long period stop controller drives the warp tension control means before the start of the normal working hours so that the warp tension is set to a predetermined normal tension, and thereafter prepares for the next start of the loom.

As mentioned above, the warp tension is set to the appropriate value depending on the length of the stop time. It is therefore possible to prevent the generation of weaving bars caused by the stretch of the warp during the loom stop pages.

Inasmuch as the warp tension is set to the appropriate value depending on each mode of stop page of the loom, i.e. the stop page during normal working hours for a short period of time or during unmanned operating hours for a long period of time, the stretch of the warp or the generation of weaving bars is prevented.

As the warp tension is set to the predetermined slack tension and thereafter returned to a normal tension at the stage of preparation for the restart of the loom, the warp tension is automatically returned to a given value before the fixed time at the time of restart of the loom after the loom stops for a long period of time. As a result, the warp tension is set to substantially the same value as the normal tension during the normal weaving operation so that weaving bars can be prevented with assurance.

DESCRIPTION OF THE PREFERRED EMBODIMENT

Figure 1:
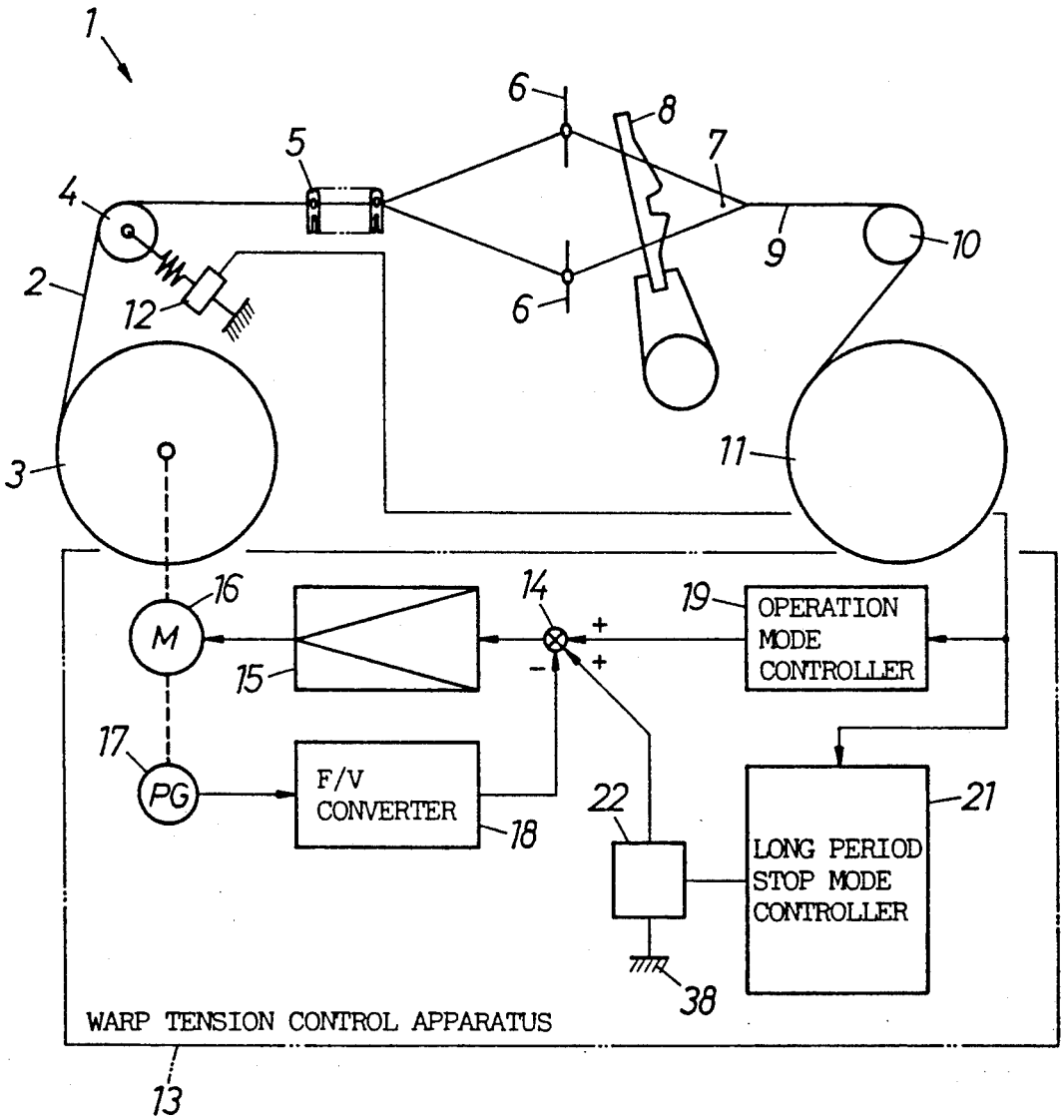
FIG. 1 is a schematic side elevation showing a loom employing a warp tension control apparatus according to a first embodiment of the present invention.

A warp tension control apparatus according to a first embodiment of the present invention will be described with reference to FIGS. 1 and 2.

A plurality of warps 2 are fed from a let-off beam 3 and arranged in a sheet and pass through a tension roller 4 along a warp line and through a stop motion 5 and interlaced with wefts 7 at a cloth fell while forming a shed by the shedding motion of a heddle 6, and thereafter beaten by a reed 8, thereby forming a woven fabric 9. The woven fabric 9 is fed through a take-up roller 10 and taken up by a cloth beam 11. The tension of the warp 2 is detected by a tension detector 12 as an electric tension signal at the tension roller 4 which is displaceable during the let-off operation of the warp. The thus detected electric signal is supplied to an operation mode controller 19 in a warp tension control apparatus 13 for serving as a closed loop control. The operation mode controller 19 compares the detected tension signal with a predetermined tension of the warp 2 of the loom during the weaving operation and supplies a resultant comparison signal through an adding point 14 to a driving circuit 15 for cancelling the deviation therebetween, thereby, controlling the rotation of a let-off motor 16 serving as a warp tension slack means. The rotation of the let-off motor 16 is detected by a pulse generator 17 as a train of pulse signals which are converted by an F/V (frequency to voltage) converter 18 into a voltage proportional to the pulse frequency, and fed back to the adding point 14 as negative feedback signals. The operation mode controller 19 controls the tension of the warp 2 to a predetermined tension during the operation of the loom 10. However, when the loom stops once, the control of the tension of the warp 2 is executed by a long period stop mode controller 21 depending on a condition of selection by a selector switch 22.

Figure 2:
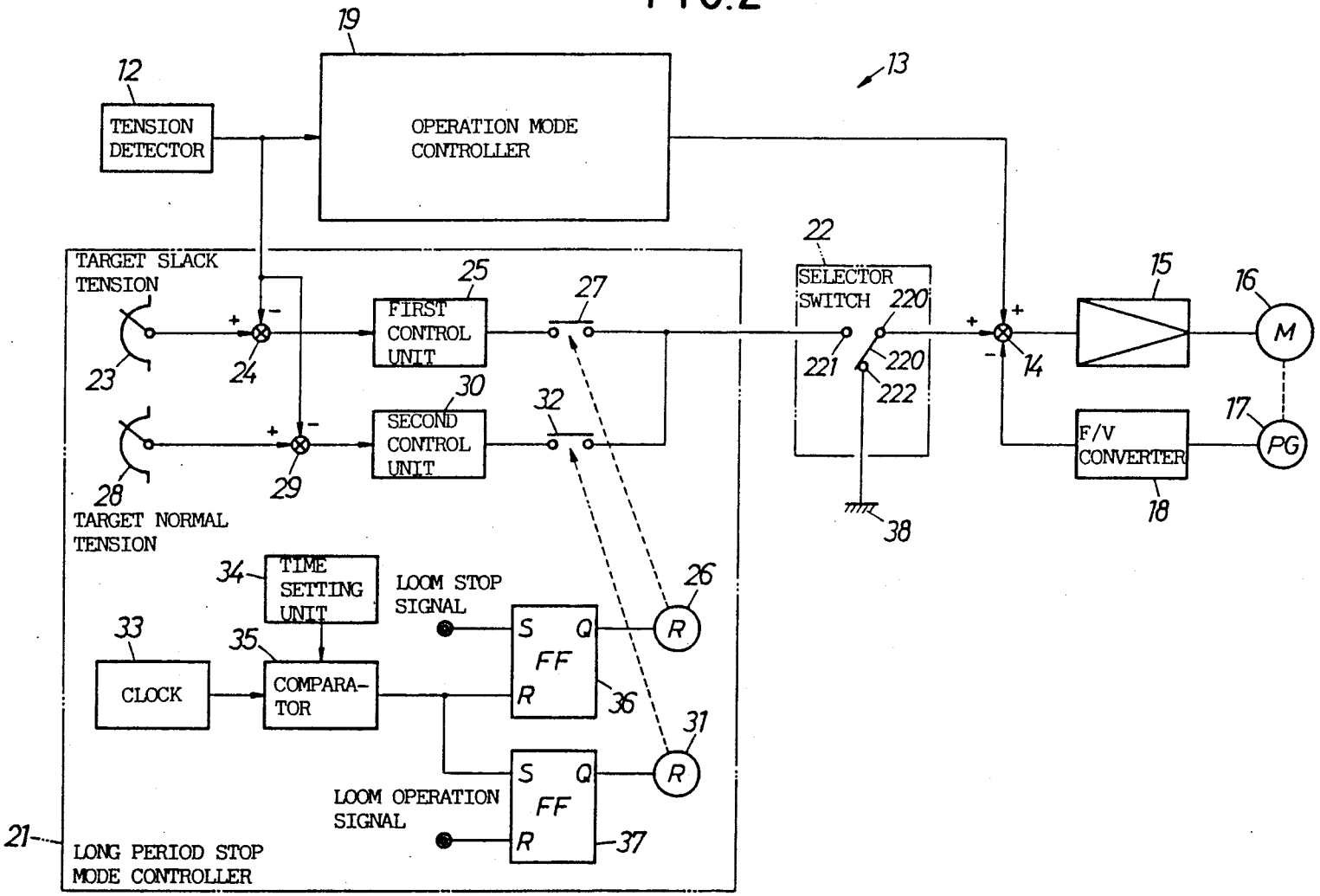
FIG. 2 is a block diagram of the warp tension control apparatus according to the first embodiment of the present invention.

FIG. 2 shows an arrangement of the long period stop mode controller 21, the adding point 14 and the selector switch 22 interposed between the long period stop mode controller 21 and the adding point 14.

The long period stop mode controller 21 comprises a first setting unit 23 for setting the warp tension to a predetermined target slack tension, a first comparator 24, a first control unit 25, a relay contact 27 for a first relay 26, a second setting unit 28 for setting the warp tension to a predetermined target normal tension, a second comparator 29, a second control unit 30, a relay contact 32 of a second relay 31, and further comprises a clock 33, a time setting unit 34, a comparator 35 and flip-flops 36 and 37 for driving the first and second relays 26 and 31.

The selector switch 22 is connected to the adding point 14 by a movable contact 220 for supplying the output of the long period stop mode controller 21 i.e. the output of the first control unit 25 or the second control unit 30 to the adding point 14 and is connected to the output of the long period stop mode controller 21 by a fixed contact 221, and is connected to e.g. a ground 38 for setting the loom to a normal stop mode by a fixed contact 222.

The operation mode controller 19 compares, as mentioned above, an actually detected tension by the tension detector 12 and the predetermined target tension and drives the driving circuit 15 depending on the deviation between the actually detected tension and the target tension during the loom 1 operation, thereby controlling the rotation of the let-off motor 16. Accordingly, the warp 2 is always let off by the rotation of the let-off beam 3 so that the tension of the warp 2 always equals the target tension. The operator previously switches the selector switch 22 to the fixed contact 222 for the normal stop mode for the normal operation so that the adding output from the selector switch 22 is always set to 0 V . Accordingly, when the loom stops during the weaving operation, the tension control signal alone is supplied to the adding point 14 from the operation mode controller 19. As a result, the tension of the warp 2 is not set to be slackened. Even if the loom 1 is driven forward or backward by an inching operation during the stop page of the loom 1, the operation mode controller 19 carries out the control of rotation of the let-off motor 16 as usual, thereby setting the tension of the warp 2 to the target tension.

The operator operates the selector switch 22 for switching the movable contact 220 to the fixed contact 221 before the mill enters its unmanned operating hours, such as night time or holidays. Accordingly, when the loom 1 stops, the control signal from the long period stop mode controller 21 is supplied to the adding point 14.

When the loom 1 stops owing to a stoppage caused by a weft stop, for example, during unmanned operating hours, a loom stoppage signal of an H level is supplied to the flip-flop 36 so that the flip-flop 36 is set, thereby rendering the relay contact 27 of the first relay 26 ON. At this time, the first comparator 24 makes a comparison between the target slack tension set by the first setting unit 23 and the actually detected tension of the warp 2 detected by the tension detector 12 and issues a signal representing the difference, i.e. deviation of the resultant comparison. The signal, i.e. a deviation signal, is converted by the first control unit 25 as a slack tension control signal and is supplied to the driving circuit 15 by way of the selector switch 22 and the adding point 14. Accordingly, the left-off motor 16 drives the let-off beam 3 toward the let-off direction, i.e. the forward direction, and thereafter sets the tension of the warp 2 to the target slack tension which is sufficiently lower to cope with the long period of stop page of the loom. At this time, the output from the operation mode controller 19 is cancelled.

On the other hand, the comparator 35 compares the time of the clock 33 with the time set by the setting unit 34 and resets the flop-flop 36 at the time when both the time of the clock 33 and the time set by the setting unit 34 coincide, i.e. at a given time which is close to the start of the normal working hours while setting the flip-flop 37. As a result, the second relay 31 is driven for rendering the relay contact 32 ON and the relay contact 27 OFF. Consequently, the second comparator 29 compares the target normal tension set by the second setting unit 28 with the actually detected tension of the warp 2 detected by the tension controller 12, and issues a signal representing the difference, i.e. the deviation of the resultant comparison. The signal, i.e. a deviation signal, is converted by the second control unit 30 as a normal tension control signal and is supplied to the driving circuit 15 depending on the deviation therebetween by way of the selector switch 22 and the adding point 14. The driving circuit 15 drives the let-off motor 16 in the backward direction so that the tension of the warp 2 is increased to the normal tension value for preparation for the restarting of the loom. Accordingly, the time set by the time setting unit 34 is set to be a first normal working hour after the lapse of the unmanned working hours, such as around 8:20 just before 8:30. If the loom 1 is thereafter set in a starting state, the second flip-flop 37 is reset by an operation signal of the loom 1 so that the relay contact 32 is set to be OFF. It is a matter of course that the operator operates the selector switch 22 for switching the movable contact 220 from the fixed contact 221 to the fixed point 222 for preparation of the normal operation. Inasmuch as the target normal tension set by the second setting unit 28 serves for increasing the tension of the warp 2 to the normal tension value for the preparation of the start of the loom 1, it is possible to omit the setting unit 28 and control the target value during the operation of the loom 1 set inside the operation mode controller 19 as the target normal tension instead of the setting unit 28.

The long period stop mode controller 21 sets the tension of the warp 2 to a slack tension value which is lower than the normal tension for the preparation of the long period of stop page of the loom 1 during the unmanned operating hours and returns the tension to the normal tension during the preparation before the normal operation for the next start, if need be.

The selector switch 22 can be a mere on-off switch by omitting the fixed contact 222. At the normal stop page of the loom 1, the selector switch 22 is set to be OFF so that the long period stop mode controller is separated from the adding point 14. When the long period of stop page of the loom is envisaged, the selector switch is set to be ON so that the long period stop mode controller 21 is connected to the adding point 14.

Although the rotation of the let-off motor 16 is controlled for slacking the tension of the warp 2 according to the first embodiment, it is also controlled by a known warp tension slack means such as means for displacing the tension roller 4 or the means for rotating the take-up motor of the take-up roller 10 the take-up direction.

An arrangement of the warp tension control apparatus according to a second embodiment will be described with reference to FIG. 3.

Figure 3:
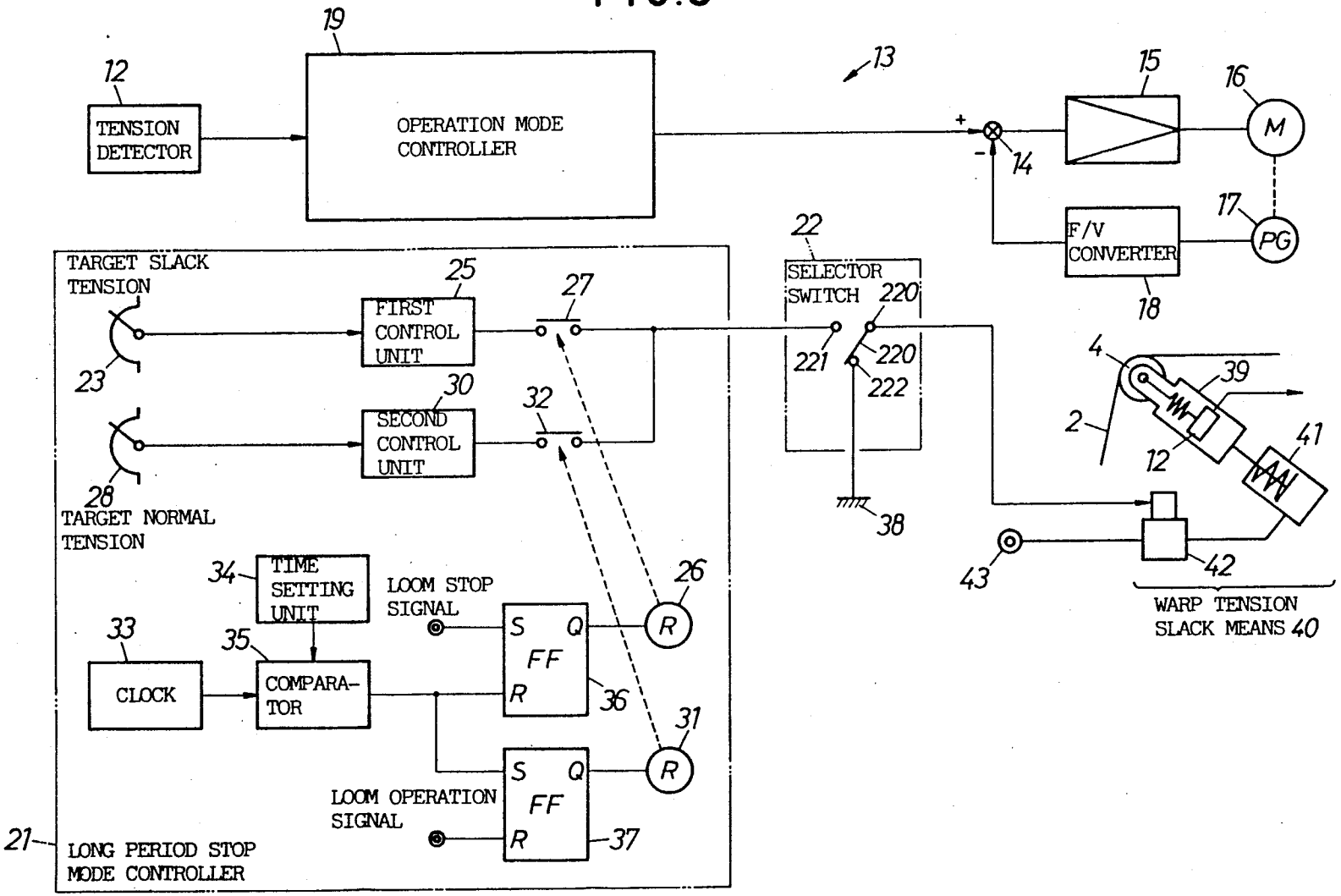
FIG. 3 is a block diagram showing a warp tension control apparatus according to a second embodiment of the present invention.

The arrangement of FIG. 3 is provided with the long period stop mode controller 21 independent of the operation mode controller 19 for forming an open loop control system for controlling an exclusive warp tension slack means 40 without receiving the tension detected by the tension detector 12. According to the exclusive warp tension slack means 40, the tension roller 4 and a holder 39 of the tension detector 12 are slidably movable toward the direction for generating the resultant force of the warp 2 by a pneumatic cylinder 41 for displacing the tension roller 4. A pressure regulating valve 42 of the warp tension slack means 40 regulates the air under pressure supplied from the pressure source 43, thereby setting an internal pressure of the pneumatic cylinder 41 to the target slack tension or the target normal tension.

Figure 4:
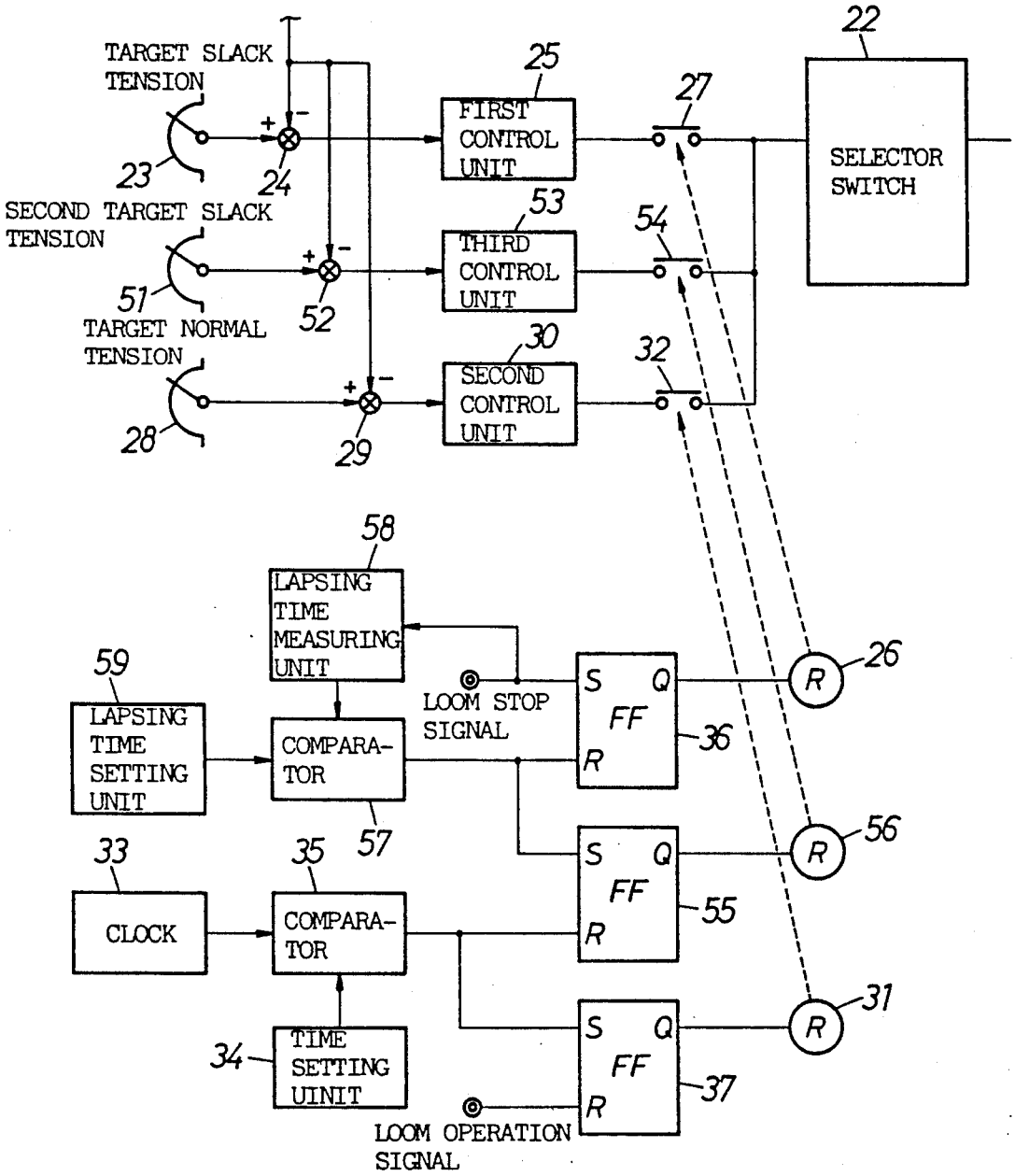
FIG. 4 is a block diagram showing a main portion of a warp tension control apparatus according to a third embodiment of the present invention.

A warp tension control apparatus according to a third embodiment will be described with reference to FIG. 4.

The warp tension control apparatus according to the first and second embodiments discloses that the long period stop mode controller 21 is operated for slackening the warp tension on the basis of a single target slack tension during the loom 1 stoppage.

However, the warp tension control apparatus can measure the time which has elapsed after the stoppage of the loom 1 and further slacken the warp tension after the passage of a given time. That is, a second target slack tension can be set by a third setting unit 51 in addition to the target slack tension set by the first setting unit 23 as illustrated in FIG. 4. A lapsing time measuring unit 58 receives a loom stop signal and measures the passage of time after the loom has stopped. A comparator 57 compares a predetermined lapsing time set by a time setting unit 59 with an actual passage of time measured by a lapsing time measuring unit 58 and issues a signal when the times coincide for resetting the flip-flop 36 while a flip-flop 55 is set. Consequently, the relay contact 27 of the first relay 26 is OFF while a relay contact 54 of a relay 56 is ON. Accordingly, the second target slack tension set by the third setting unit 51 and the actual tension detected by the tension detector 12 are compared with each other by the third comparator 52. As a result, the third comparator 52 issues a second target slack tension control signal which is supplied to the driving circuit 15 by way of the selector switch 22 and the adding point 14. The driving circuit 15 drives the let-off motor 16 in the backward direction so that the tension of the warp 2 is further slackened.

In the weaving mill provided with a centralized control system, a host computer transmits a mode selection command to each loom by way of a transmission line so that each selector switch of each loom can be remotely automatically switched. That is, the movable contact 220 of the selector switch 22 of each loom can be automatically and simultaneously switched to the fixed contact 221 connected to the output of the long stop period stop mode controller 21 at the start of the unmanned operating hours and to the fixed contact 222 at the start of the normal working hours.

The selector switch 22 can be automatically switched to the fixed contact 221 connected to the output of the long period stop mode controller 21 using the signal issued by the timer. That is, the timer measures the passage of time after the stoppage of the loom 1 and the selector switch 22 can be automatically switched to the fixed contact 221 connected to the output of the long period stop mode controller 21 when the measured time exceeds the predetermined time. If the loom 1 has an automatic mending device for mending a defective weft and the like, the selector switch 22 can be automatically switched to the side of the output of the long period stop mode controller 21 when it receives a mending defective signal.

The operation to switch the selector switch 22 to the fixed contact 222 is interlocked with ON operation of a preliminary switch which is pushed before the start of the loom 1 at the start of the normal working hours. It is a matter of course to use a start switch of the loom instead of the preliminary switch. In short, a signal to be issued involved in the start of the loom may be used.

Such an automatic switching of the selector switch 22 makes it possible to prevent the omission of the switching of the selector switch 22 beforehand. The selector switch may comprise a contact switch or a non-contact switch.

Figure 5:
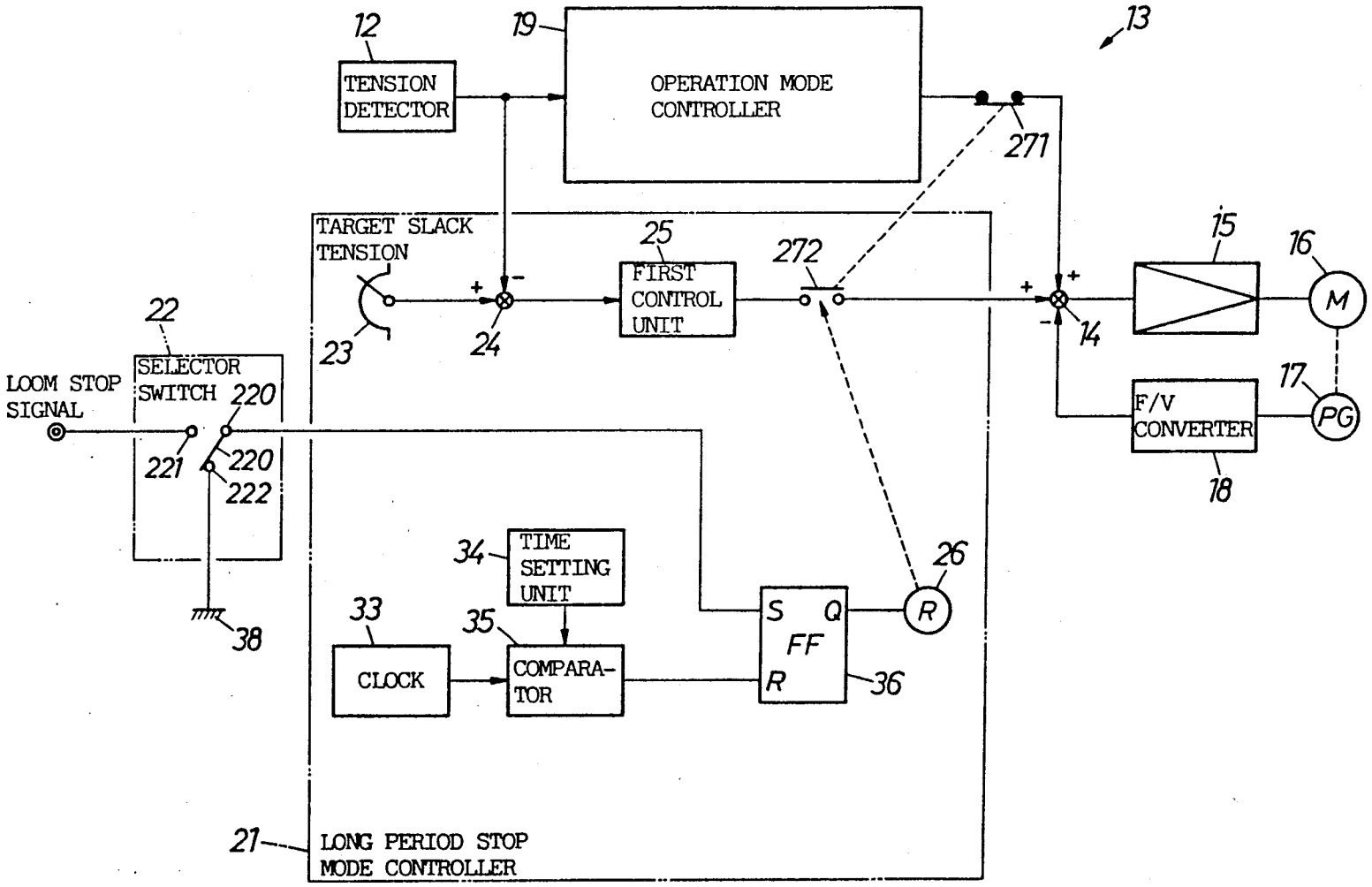
FIG. 5 is a block diagram showing a warp tension control apparatus according to a fourth embodiment of the present invention.

A warp tension control apparatus according to a fourth embodiment will be described with reference to FIG. 5 which shows a modification of the arrangement of FIG. 2.

The selector switch 22 is provided in series with the line where the loom stop signal is supplied to the flip-flop 36, i.e. at the input side of the flip-flop 36. The first relay 26 drives interlocking contacts 271 and 272 while the function of the second control unit 30 is carried out by the operation mode controller 19, thereby omitting the second setting unit 28 and the second control unit 30.

If the loom stop signal is generated when the selector switch 22 is switched to the side to which the loom stop signal is supplied, the flip-flop 36 is set, thereby opening the interlocking contact 271 so that the output of the operation mode controller 19 is cancelled while the output of the first control unit 25 is supplied to the driving circuit 15 by way of the interlocking contact 272.

As the flip-flop is set at the fixed time, the interlocking 272 contact is open while the interlocking contact 271 is closed so that the operation mode controller 19 sets the tension of the warp 2 to the normal tension value in preparation for the restart of the loom.

What is claimed is:

1. A warp tension control apparatus for a loom comprising:

a tension detector for detecting a tension of a warp;

an operation mode controller for generating a control signal to drive a let-off motor so as to minimize a deviation between the detected tension and a predetermined normal target tension;

a long period stop mode controller for outputting a slack tension control signal to a warp tension slack means so that a target slack tension is set to be less than said target normal tension, which has been previously set in a first tension setting unit when a loom stop signal has been issued, wherein the warp tension is set to a value less than that of a normal operation when the loom is stopped;

a selector switch, for selectively switching to a contact connected to an output of said long period stop mode controller before entering a long unmanned operating period of the loom, said switch being disposed in a circuit between an input terminal of said long period stop mode controller which receives a loom stop signal and said warp tension slack means; and a switch for stopping the output of the operation mode controller when said long period stop mode controller outputs said slack tension control signal; wherein the warp tension when the loom is stopped is set to be less than that at the time of normal operation only when said selector switch is selectively switched to a contact connected to said output of said long period stop mode controller.

2. A warp tension control apparatus for a loom according to claim 1, wherein said let-off motor also comprises said warp tension slack means.

3. A warp tension control apparatus for a loom comprising:

a tension detector for detecting a tension of a warp;

an operation mode controller for generating a control signal for driving the let-off motor so as to minimize a deviation between a detected warp tension by the tension detector and a previously set normal target tension;

a long period stop mode controller for outputting a slack tension control signal to a warp tension slack means so that a target slack tension is set to be less than the normal target tension which has been previously set in a first tension setting unit when a loom stop signal issued, wherein the warp tension is set to a value less than that of a normal operation when the loom is stopped;

a selector switch for selectively conducting a control signal from the operation mode controller;

a selector switch for selectively conducting a control signal from the long period stop mode controller;

a switching means for turning said two selector switches on and off when a warp stop signal is produced and for restoring said two switches to their original states at a predetermined time just before an unmanned operating period ends; and another selector switch for selectively switching to a contact connected to an output of said long period stop mode controller before entering said long unmanned operation period of the loom, said switch being disposed ahead of an input terminal portion of the switching means which receives the loom stop signal;

wherein the warp tension when the loom is stopped is set to a value less than that of a normal operation only when said another selector switch is selectively switched to a contact connected to said output of said long period stop mode controller and the warp tension when the loom is stopped is restored to a value which is same as that during normal operation at a predetermined line just before the unmanned operation period ends.

4. A warp tension control apparatus for a loom according to claim 3, wherein said let-off motor also comprises said warp tension slack means.

5. A warp tension control device for a loom comprising:

a tension detector for detecting a tension of a warp;

an operation mode controller for generating a control signal to drive a let-off motor so as to minimize deviation between the detected tension and a predetermined normal target tension;

a long period stop mode controller for outputting a slack tension control signal to a warp tension slack means so that the target tension is set to be less than said normal target slack tension which has been previously set in a first tension setting unit when a loom stop signal has been issued, wherein the warp tension is set to a value less than that of a normal operation when the loom is stopped;

said long period stop mode controller comprises a first controller for outputting said slack tension control signal to said warp tension slack means so that said target slack tension is set to be less than the normal target tension when said loom stop signal is issued, and a second controller for producing a normal target tension control signal from a second tension setting unit at a predetermined instant of time just before the unmanned operating period ends when said first controller is outputting said slack tension control signal to said warp tension slack means;

a selection switch for selectively switching to a contact connected to an output of said long period stop mode controller before said long unmanned operating period of the loom, said switch being disposed one of either ahead of an input terminal side of said long period stop mode controller for receiving said loom stop signal and on an output side thereof for outputting a control signal to said warp tension slack means; and a switch for stopping an output from said operation mode controller when said long period stop mode controller outputs a control signal; wherein the warp tension when the loom is stopped is set to a value less than that of a normal operation only when said selection switch is selectively switched to a contact connected to said output of said long period stop mode controller and the warp tension when the loom is stopped is restored to a normal operation value at a predetermined time just before said unmanned operating period ends.

6. A warp tension control apparatus for a loom according to claim 5, wherein said let-off motor also comprises said warp tension slack means.

* * * * *